United States Patent [19]

Burland

[11] Patent Number: 4,768,900

[45] Date of Patent: Sep. 6, 1988

[54] PILES AND ANCHORAGES

[76] Inventor: John B. Burland, 13 Barton Road, Wheathampstead, St. Albans, Hertfordshire AL4 8QG, England

[21] Appl. No.: 48,978

[22] Filed: May 12, 1988

Related U.S. Application Data

[63] Continuation of Ser. No. 817,731, filed as PCT GB85/00182, Apr. 29, 1985, published as WO85/05137, Nov. 21, 1985, abandoned.

[30] Foreign Application Priority Data

May 1, 1984 [GB] United Kingdom ..... 8411107

[51] Int. Cl.[4] ..... E02D 5/74

[52] U.S. Cl. ..... 405/244; 405/233; 405/259; 405/232

[58] Field of Search ..... 405/259; 411/42–45

[56] References Cited

U.S. PATENT DOCUMENTS

| | | | |
|---|---|---|---|
| 2,696,137 | 12/1954 | Thomas et al. | 405/259 |
| 3,626,803 | 12/1971 | Liebig | 411/42 |
| 3,628,337 | 12/1971 | Stepantch et al. | 405/244 |
| 4,312,604 | 1/1982 | Fu et al. | 405/259 |
| 4,342,527 | 8/1982 | White | 405/259 |
| 4,401,397 | 8/1983 | Sommer et al. | 405/133 |
| 4,547,106 | 10/1985 | Lipsker | 405/259 |

FOREIGN PATENT DOCUMENTS

| | | | |
|---|---|---|---|
| 964088 | 3/1975 | Canada | 405/259 |
| 498826 | 1/1939 | United Kingdom | 411/42 |

*Primary Examiner*—Dennis L. Taylor
*Attorney, Agent, or Firm*—Kinney & Lange

[57] ABSTRACT

A piling structure or ground anchor comprising at least one piling member portion adapted to be driven into the ground or inserted into a pre-bored hole therein (31); a spreading mandrel member (34,40) adapted to be passed into the structure or ground anchor so as to expand the piling member (31) portion laterally into the ground; and holding means (45) for holding the piling member portion in its expanded disposition.

24 Claims, 6 Drawing Sheets

PILES AND ANCHORAGES

This is a continuation of application Ser. No. 817,731, filed as PCT GB85/00182 on Apr. 29, 1985, published as WO85/05137 on Nov. 21, 1985, now abandoned.

BACKGROUND OF THE INVENTION

Field of the Invention

This invention relates to piles and anchorages. More particularly this invention relates to piles of the kind used for structural support purposes and anchorages of the tie-back kind or of the kind embedded in a sea floor, for example, used for holding floating or semi-submerged structures in position in the sea. Structural support piles and anchorages of this kind have similar requirements in that their firm location within the ground is a prime consideration. For convenience hereafter reference is made only to piles and piling members and portions but it is to be understood that this expression is used generically and includes anchorages of the kind just mentioned and corresponding parts thereof except where the context forbids.

It is known to use steel members of 'H' section as piling structures. The advantages of such piles are that they are light and robust to handle; they are easily cut down or extended in length; that they can carry high compressive and tensile loads and high driving stresses; that small volumes of displacement are involved so that they are easy to drive to great depth and through hard intermediate strata; that they are easy to drive in closely spaced groups; and that they involve minimal disturbance of surrounding ground.

It is also known to use large displacement solid or hollow driven piles made of various materials such as steel, concrete and timber. The advantages of such piles is that they give higher end bearing and shaft resistance than 'H' Section piles and the cost of materials may be less.

Again it is known to use bored piles whereby a hole is bored in the ground and subsequently filled with concrete or grout. Such piles have often proved economic and have the advantage that their installation induces little or no vibration in the surrounding ground.

Despite the above mentioned advantages, 'H' Section piles do have severe disadvantages in that their small cross sectional area minimizes both end bearing resistance and shaft resistance. It has already been proposed to overcome the above mentioned disadvantages by driving the piles to considerably extended depths so as to increase to satisfactory levels the shaft resistance, welding "wings" onto the sides of the 'H' Section piling member, and by welding wings and plates onto the 'H' Section member near its lower end. Whilst all of these proposals might well increase the end bearing resistance of the pile, they all substantially reduce the positive advantages of the 'H' Section member of easy driving and add considerably to the pile driving operation costs.

Again all driven piles cause severe disturbance to the soil around the pile which may be detrimental to its load carrying capacity. Thus, when used in clay soils orientation of clay particles down the side of the pile gives rise to low residual angles of friction. Yet again, in granular soil, a critical or limiting depth of penetration is reached early on below which friction per unit pile length ceases to increase because of an arching phenomena of the juxtaposed material. Again in strata formed of weakly cemented material such as chalk or carbonated sand, shaft resistance is exceptionally low due to grain crushing at the shaft to ground interface and subsequent arch around the pile. Finally, it has been noted that "whipping" of the pile during driving can significantly reduce the shaft friction.

Again for bored piles there are a number of disadvantages such as deterioration of the sides of the borehole, stress relaxation of the ground around the pile shaft, difficulties of ensuring stability of the borehole before or during concreting or grouting, ensuring integrity of the pile during its formation.

SUMMARY OF THE INVENTION

It is an object of the present invention to overcome or at least substantially reduce the above mentioned problems.

According to one aspect of the present invention there is provided a piling structure or ground anchor comprising at least one piling member portion adapted to be driven into the ground or inserted into a prebored hole therein; a spreading mandrel member adapted to be passed into the structure or ground anchor so as to expand the piling member portion laterally into the ground; and holding means for holding the piling member portion in its expanded disposition.

According to another aspect of the present invention, there is provided a method of forming a piling structure or ground anchor comprising inserting into the ground at least one piling member portion; passing a spreading mandrel member into the structure or ground anchor so as to expand the piling member portion laterally into the ground; and holding the piling member portion in its expanded disposition.

The mandrel member may comprise a wedge-like member which may have a shank portion of lesser cross-section than a spreading head portion.

The mandrel may be adapted to be inserted from outside the ground into the structure or ground anchor after the piling member portion in the ground.

In an alternative arrangement the mandrel is driven into the ground or inserted into a pre-bored hole therein ahead of the piling member portion and is then withdrawn through the structure or ground anchor to expand the piling member portion.

The arrangement may include two or more elongate piling member portions, which may be formed of steel, adapted to be driven or inserted into the ground into an adjacent side by side disposition, the spreading mandrel being adapted to force apart the portions to expand them into the ground.

Alternatively, the arrangement may comprise a plurality of piling member portions in the form of a succession of rings, which may, be formed of any suitable material such as concrete, plastics, materials, fibre reinforced cement, for example, inserted one on top of the other in the ground, the rings being provided with a plurality of axially aligned weak lines spaced thereabout whereby the mandrel member opens out the rings along the weak lines to expand the piling member portions.

The weak lines may be cracked or may stretch plastically depending on the material and the construction used.

The mandrel may either be left permanently in place between the pile members or may be withdrawn and replaced with concrete or grout or similar material. In the latter case spacers may be provided on the pile members such that upon the members being separated by the mandrel, the sub members are thereafter held in place by the spacers.

The invention is based upon an appreciation that, from a study of the mathematics involved in pile function, major benefits to shaft resistance can be gained from increasing the available normal stress in piling structures.

Where elongate piling member portions are used, these may be of any convenient configuration, and may be, for example, of channel section, in which two pile members may be used. Alternatively, angle section 'L' members may be used in which case four members may be used to provide either a box or a cruciform section structure. Again, for example, pile members of 'V' section can be used in which, if the 'V' angle is 120°, three members may be used. Yet again, arcuate section members may be used to provide a circular structure.

The piling member portions may be provided with grooves or a ribbed surface to improve the resistance between the pile surface and the ground. Again, the inner surface of the piling member portions may be shaped to improve the bond between the member and the eventual concrete filler.

The mandrel is preferably designed to ensure that during movement thereof between the pile members these do not expand excessively radially and then contract since this would seriously reduce the loading capability of the pile structure.

The mandrel may comprise a wedge like member and may consist of two sections, namely a nose which has the function of expanding the pile members into the surrounding ground and may be of tapered configuration. Secondly, the mandrel may include a shank section of slightly reduced cross-section compared to the nose so as to reduce the friction between the mandrel and the expanded piles during movement.

The mandrel may contain an axially extending bore for the transmission of a settable filler material such as concrete or grout or similar material to and through the nose so that the space after expansion of the pile members may be filled thereby upon withdrawal of the mandrel.

As hereinabove mentioned, spacers may be inserted between the expanded pile members so as to maintain pressure between the expanded pile structure and the surrounding ground once the nose of the mandrel has passed beyond any given portion of the pile, or has been withdrawn, and to prevent the expanded pile members from closing in on the shank section of the mandrel which would substantially increase the friction between the mandrel and pile members.

The spacers may be mounted on one or more of the pile members and may be pivotally mounted so as to turn and lock into position on the passage of the spreading mandrel between the piling members.

BRIEF DESCRIPTION OF THE DRAWINGS

In order that the invention may be more readily understood, a number of embodiments thereof will now be described by way of example with reference to the accompanying drawings in which.

DETAILED DESCRIPTION OF THE PREFERRED EMBODIMENTS

In the various parts of FIG. 1 are illustrated a piling structure in which four 'L' section elongate steel piling member portions 31 are held together lightly and temporarily (eg by tack welding) into a box section structure as shown in FIG. 1(*d*). A driving shoe 32 is fitted within the lower end of the structure, and this is then driven into the ground 33 to the position shown at 1(*a*).

A spreading mandrel 34 is then driven into the structure as shown in FIG. 1(*b*). This separates and expands the piling member portions until the final disposition of FIGS. 1(*c*) and 1(*e*) is reached when the mandrel and the driving shoe can be withdrawn with the piling structure held in its expanded position by spacers as hereinafter described.

It is to be noted that the expansion may be done with a single pass of one mandrel or by successive passes of increasingly wider mandrels. The piling structure may be expanded by different amounts along its length to take account of varying driving conditions.

Figure 1A:
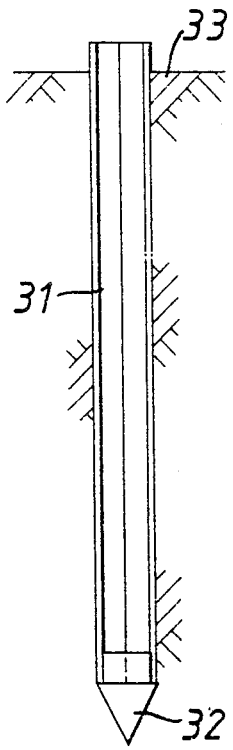
FIGS. 1(*a*)(*b*)(*c*)(*d*) and (*e*) show one embodiment of the invention and its operation.
Figure 1B:
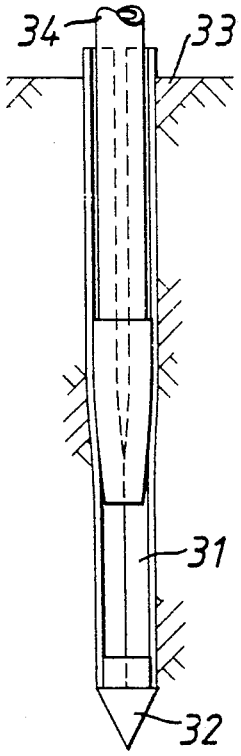
Figure 1C:
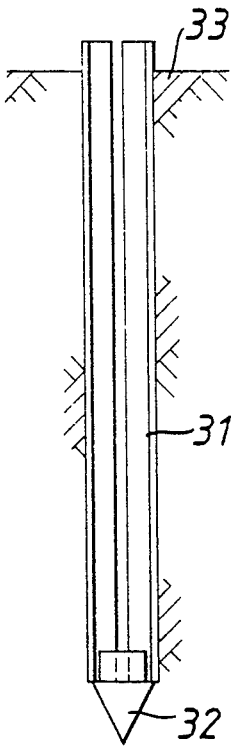
Figure 1D:
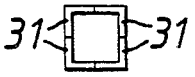
Figure 1E:
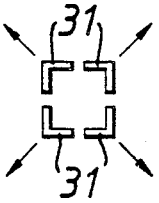
Figure 2:
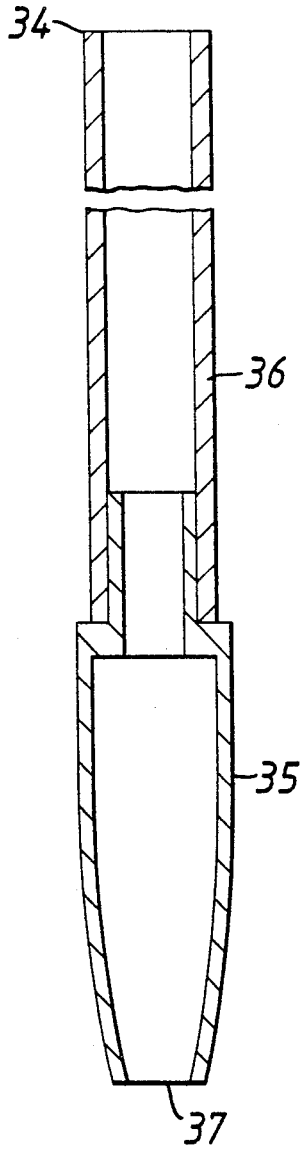
FIG. 2 shows the mandrel of the embodiment of the invention of FIG. 1 in more detail.
Figure 3A:
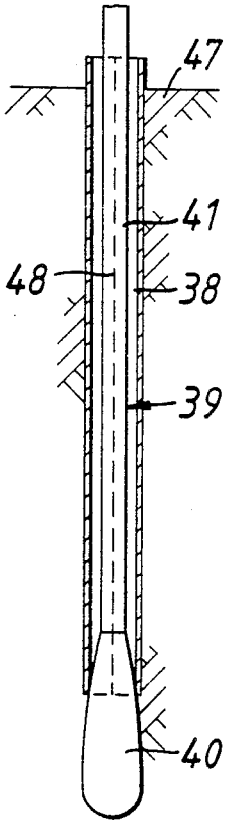
FIGS. 3(*a*)(*b*)(*c*)(*d*) and (*e*) show a second embodiment of the invention and its operation.
Figure 3B:
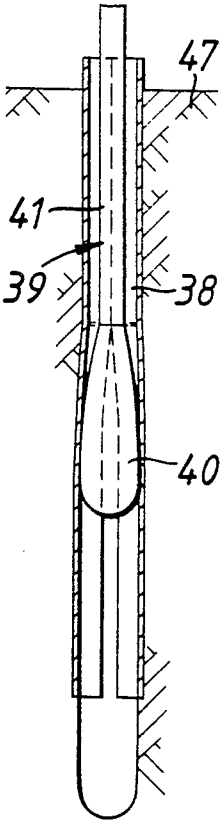
Figure 3C:
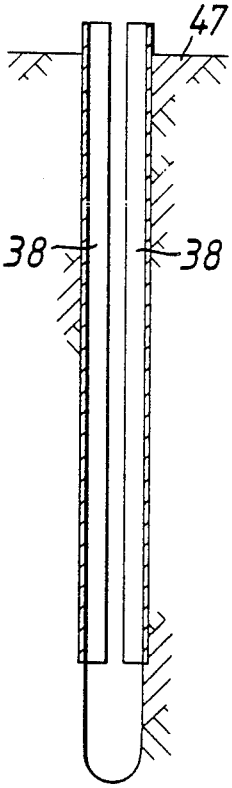
Figure 3D:
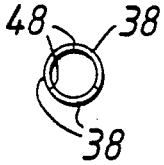
Figure 3E:
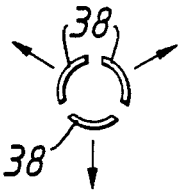
Figure 4A:
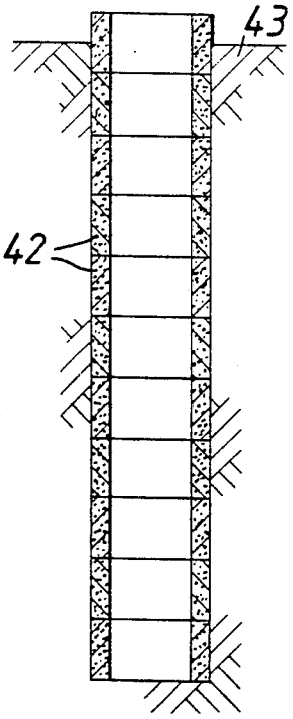
FIGS. 4(*a*)(*b*)(*c*) and (*d*) show a third embodiment of the invention and its operation.
Figure 4B:
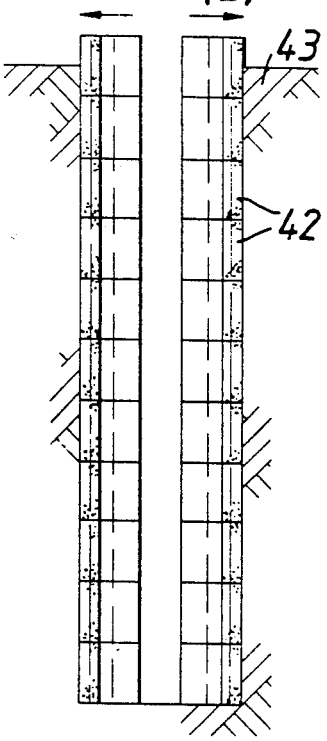
Figure 4C:
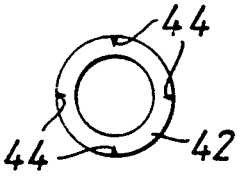
Figure 4D:
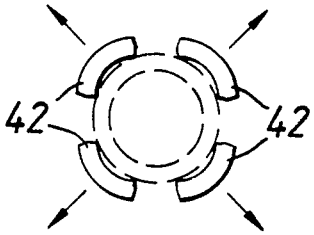

A typical spreading mandrel is shown in FIG. 2. As can be seen, the mandrel is in the form of a somewhat wedge shaped nose portion 35 and a shank portion 36 of less cross-section than the nose portion to reduce the friction of the mandrel during movement. The mandrel is hollow and open at the tip 37 of its nose for the passage therethrough of grout or concrete.

An alternative piling structure is shown in FIGS. 3(*a*)(*b*)(*c*)(*d*) and (*e*). In this arrangement a steel tube 38 with a plurality of longitudinal weak lines 48 (for example grooves) comprises the piling member portion, whilst a mandrel 39 extends through the tube. The mandrel of this embodiment is of a reverse configuration to that of FIG. 2 in that the spreading wedge shaped portion 40 is drawn through the tube by a reduced section pulling portion 41. In operation the tube, together with the mandrel, is driven into the ground 47, or placed in a pre-bored hole therein, and the mandrel then pulled through the tube by means, for example of jacks or a winch, so that the tube expands at its longitudinal weak lines 48.

Such an arrangement is of use, for example, in the provision of deep water tension piles where pile driving is inappropriate.

Yet another piling structure is shown in FIGS. 4(*a*)(*b*)(*c*) and (*d*).

In this arrangement the piling member portions are comprised by a plurality of concrete rings 42 placed in a pre-bored hole in the ground 43 or driven into position. Each ring has a plurality of notches or grooves 44 spaced therearound and extending axially of the ring which act as weak lines.

Upon the passage of a spreading mandrel through the rings, they crack open at the grooves 44 so as to be expanded to the position shown in FIGS. 4(*b*) and (*d*).

The piling member portions of any of the embodiments illustrated may be provided with grooves or a ribbed surface to improve the frictional resistance between the pile member surface and the ground. Again, the inner surface of the piling member portions may be recessed to improve the bond between the ring and the eventual concrete or grout filler.

Figure 5A:
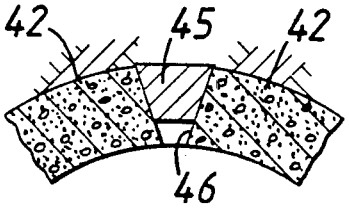
FIGS. 5(*a*) and (*b*) illustrate the operation of one form of spacers.
Figure 5B:
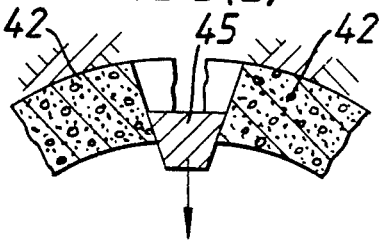

FIGS. 5(*a*) and (*b*) illustrate the operation of one form of spacing member for holding the structure of FIG. 4 in its expanded disposition. Wedges 45 are placed in corresponding shaped tapered holes 46 lying along the grooves 44 of each ring 42. Upon expansion of the rings and the cracking thereof along the grooves 44, the wedges are forced inwardly by external pressure of the ground to the position shown in FIG. 5(*b*), whereby the rings are held in the expanded disposition. The external pressure of the ground which forces the wedges inwardly is created or enhanced because the ground or soil is plastic and will flow into the void containing the wedge, thereby pushing it inwardly as the ring is expanded outwardly.

Figure 6A:
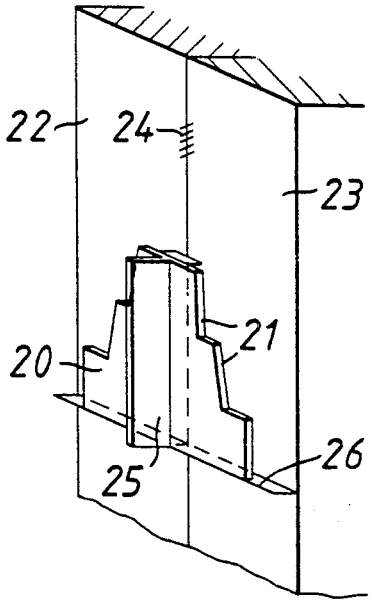
FIGS. 6(*a*) and (*b*) illustrate the operation of a second form of spacers.
Figure 6B:
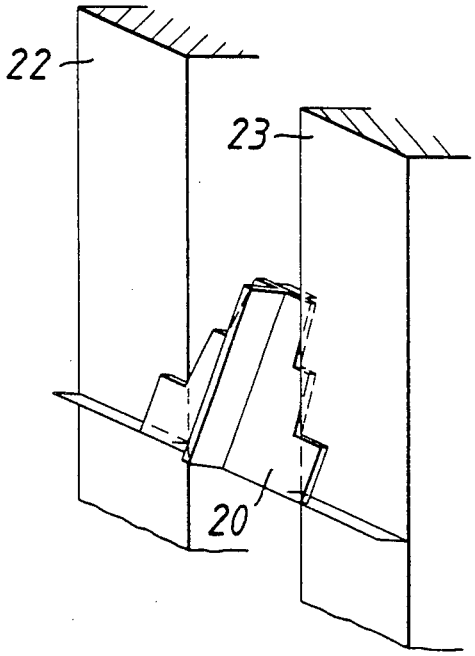

FIGS. 6(*a*) and (*b*) illustrate another form of spacer for use with a piling structure such as that of FIG. 1. The spacer is in the form of a pivotted stepped spacing wedge member 20. In frontal appearance the wedge comprises a number of slightly tapered steps 21, the dimensions of which depend upon the dimensions of the wedge mandrel or mandrels to be used to expand the pile members 22 and 23 as can be seen from FIG. 6 the pile members are temporarily connected together at 24 during driving. After driving the pile, a mandrel (not shown) is forced therebetween and driven the length of the pile and the pivotted spacing member pressed into position by the expanding action of the piles between the pile members 22 and 23 to hold them apart. The spacer is provided with a fin 25 normal to its main surface and parallel to the axis of the pile which serves to maintain the spacer in position during driving and expansion. The spacer is pivotted at its lower end 26 and may be temporarily fastened to the piles at its upper end by means of a pin (not shown) engaging in a lug (not shown) attached to the sides of each pile member.

Figure 7A:
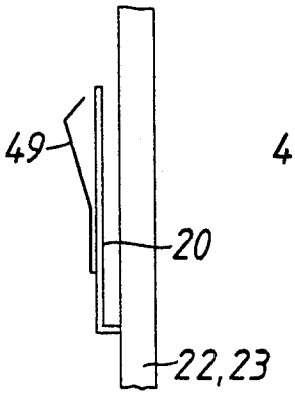
FIGS. 7(*a*)(*b*) and (*c*) illustrate the operation of a variant of the spacers of FIGS. 6(*a*) and (*b*)
Figure 7B:
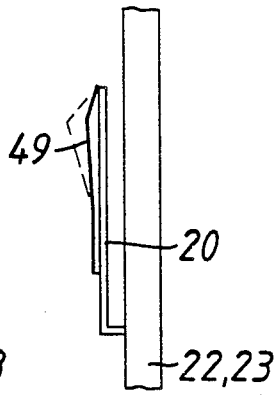
Figure 7C:
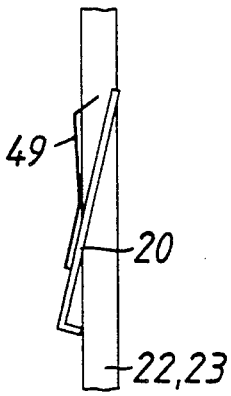

FIGS. 7(*a*)(*b*) and (*c*) illustrate a spring urged spacer. The spacing members 20 are fitted with a leaf spring 49 (FIG. 7(*a*)). During insertion of the piling structure into the ground the spring 49 is flattened against the outer face of the member 20 thereby developing a 'spring loading' (FIG. 7(*b*)). During expansion of the piling members 22,23 this spring loading action assists in pressing the spacing member 20 into position (FIG. 7(*c*)).

It will, of course, be understood that spacers of other suitable configuration and design can be utilized. Thus spacers may be located in holes drilled through the pile members which are drawn into position between the pile members by the mandrel. Alternatively such spacers may be cut by a cutter mounted on the mandrel and thereby forced into position. Yet again spacers may initially be attached to the wedge mandrel which carries them down between the pile members and then leaves them in position on withdrawal.

Figure 8:
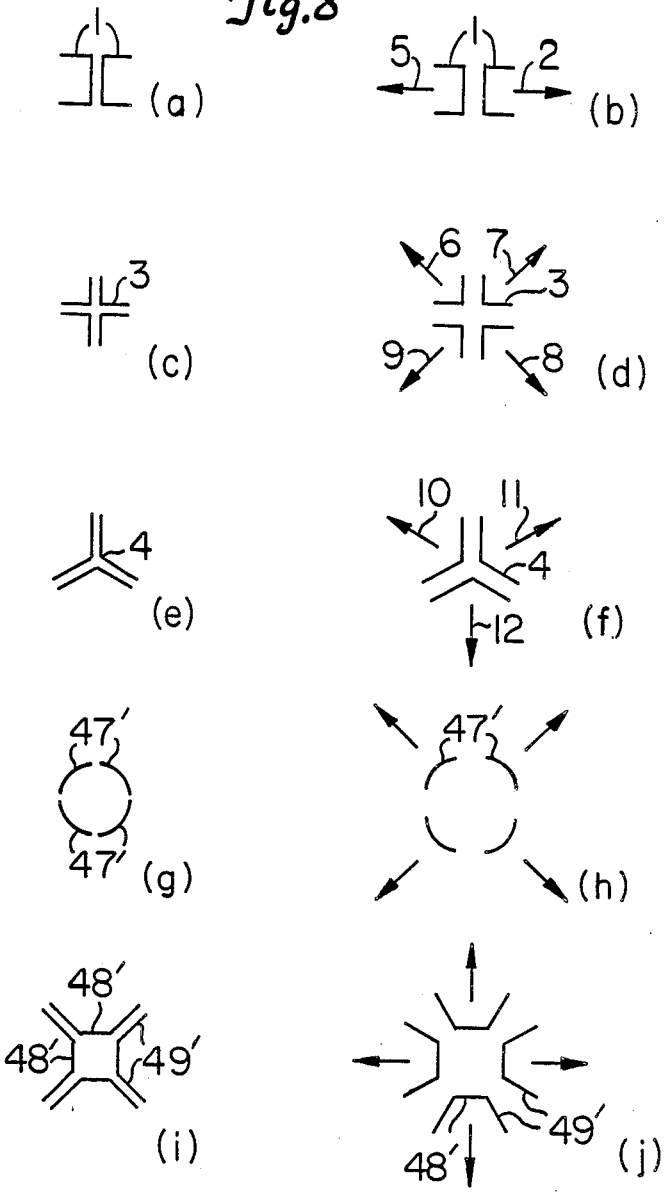
FIGS. 8(*a*) through (*j*) show alternate forms of elongate piling members.

FIG. 8 illustrates various alternate sections of elongate steel pile members.

The first three are in pairs disposed in a "back to back" arrangement. In FIGS. 8(*a*) and (*b*) they comprise channel members 1 which can each be expanded in two directions 2 and 5 as illustrated. The angles of the members 3 and 4 of FIGS. 8(*c*) and (*e*) are of 90° and 120° respectively, and with these sections expansion by means of an appropriately shaped mandrel can take place in four and three directions, 6, 7, 8 and 9 and 10, 11 and 12 respectively (See FIGS. 8(*d*) and (*f*)).

In FIGS. 8(*g*) and (*h*) four arcuate section members 47' are provided so as to give a circular structure. Expansion is in four directions at right angles to each other.

FIGS. 8(*i*) and (*j*) show four members 48' shaped to provide a "flowed" box section structure. On expansion the flanges 49' of the members flex somewhat, maintaining a valuable pre-stress in the soil.

With all such elongate pile members as are illustrated in FIG. 8 it is possible to expand the lower portion of the structure more than the upper portion to increase the effectiveness thereof by shaping the members appropriately at their lower parts, for example, by providing internal lugs or protrusions past which the spreading mandrel must travel.

Again, after the structure has been expanded by the mandrel it is possible to insert a jack into the structure to expand it further over a local region or length.

In all embodiments of the present invention, each pile member is aligned in a first position relative to the ground, as seen in FIGS. 1(*a*)–(*c*), FIGS. 3(*a*)–(*c*) and FIGS. 4(*a*)–(*b*). The passage of the spreading mandrel along the pile member locally expands or deforms the pile member laterally into the ground. Both during and after this local lateral movement of the pile member, the pile member remains in generally parallel alignment with its prior first position, as seen in a comparison of FIGS. 1(*a*)–(*c*) or FIGS. 3(*a*)–(*c*). Thus, when a plurality of pile members are so expanded by the passage of the mandrel, their final expanded disposition is generally parallel with respect to one another as seen in FIG. 1(*c*), FIG. 1(*e*), FIG. 3(*c*), FIG. 3(*e*), FIG. 4(*b*), FIG. 4(*d*) and FIGS. 8(*a*)–(*j*).

In general, after the piling structure has been expanded to the desired amount, a grout or concrete mix may be injected between the pile members either as the (or the final) mandrel is withdrawn, or subsequent thereto. Injection of such material may take place under raised pressure or under gravity. The use of a concrete or grout filling can serve to expand the piles further into the ground, to squeeze out any soil that has moved in between the piles, to expand out from the piles into surrounding soil, to establish a rigid and permanent separation of the expanded piles, to increase the end bearing area of the composite pile, to increase the axial stiffness of the composite pile, and to increase the flexural stiffness of the composite pile.

The piling and anchorage structure of the present invention has a number of beneficial advantages. Thus, the advantages of driving steel 'H' section piles mentioned hereinabove can be fully retained; the action of the spreading mandrel causes large normal effective stresses to be developed thereby substantially increasing the shaft resistance; the amount of expansion and hence the magnitude of the normal effective stresses can be controlled by the dimensions of the spreading mandrel; the energy required to insert the spreading mandrel can, because of the predictability of the frictional forces between the mandrel and the pile, be related to the normal stresses on the pile and to the shaft resistance of the pile, so that a pile whose performance is both controllable and predictable can be obtained; and expansion of the pile after installation eliminates the loss of friction caused hitherto by "whipping" during driving.

I claim:

1. A piling structure or ground anchor comprising a deformable piling member portion adapted to be driven into the ground or inserted into a pre-bored hole therein; a spreading mandrel member adapted to be passed into the structure or ground anchor, the arrangement of the piling member portion and the mandrel being such that by passage of the mandrel the piling member portion is deformed into local lateral movement to expand the structure or ground anchor progressively therealong, laterally into the ground; and holding means for holding the structure or ground anchor in its expanded disposition.

2. A structure or anchor as claimed in claim 1 wherein the mandrel is adapted to be inserted from outside the ground into the structure or ground anchor after the piling member portion is in the ground.

3. A structure or anchor as claimed in claim 1 wherein the mandrel is adapted to be driven into the ground or inserted into a pre-bored hole therein ahead of the piling member portion and is adapted then to be withdrawn through the structure or ground anchor to expand the structure or ground anchor.

4. A structure or anchor as claimed in claim 1 wherein the piling member portion comprises:

two or more elongate member portions adapted to be driven or inserted into the ground into an adjacent side by side disposition, the spreading mandrel member being adapted to force apart the member portions to expand the structure or ground anchor into the ground.

5. A structure or anchor as claimed in claim 4 wherein the piling member portions are of an angled and/or curved section and so disposed when driven or inserted into the ground as to define a hollow section structure into which the mandrel member may be passed to force apart the portions.

6. A structure or anchor as claimed in claim 1 wherein the piling member portion is formed of steel.

7. A structure or anchor as claimed claim wherein the piling member portion comprises:

a succession of rings inserted one on top of the other in the ground, the rings being provided with a plurality of axially aligned weak lines spaced therearound whereby passage of the mandrel member into the structure opens out the rings along the weak lines to expand the structure or ground anchor.

8. A structure or anchor as claimed in claim 7 wherein the succession of rings are adapted to crack open along their weak lines upon passage of the mandrel member into the structure.

9. A structure or anchor as claimed in claim 1 wherein the mandrel member comprises a wedge-like member having a spreading head portion and a shank portion wherein the shank portion has a lesser cross-section than the head portion.

10. A structure or anchor as claimed in claim 1 wherein the holding means comprise spacers adapted to hold the structure or ground anchor in its expanded disposition.

11. A method of forming a piling structure or ground anchor comprising inserting a deformable piling member portion longitudinally into the ground; progressively deforming the piling member portion along its length by local lateral movement thereof into the ground to expand the structure or ground anchor progressively therealong laterally into the ground; and holding the structure of ground anchor in its expanded disposition.

12. A method as claimed in claim 11 wherein the spreading mandrel is inserted from outside the ground into the structure after the piling member portion is in the ground.

13. A method as claimed in claim 11 wherein the spreading mandrel is driven into the ground or inserted into a pre-bored hole therein ahead of the piling member portion and is then withdrawn through the structure to expand the structure or ground anchor.

14. A method as claimed in claim 11, wherein a settable filler material is poured into the structure after expansion thereof.

15. A piling structure comprises:

at least two piling member portions adapted to be longitudinally driven into the ground or inserted into a pre-bored hole therein in generally parallel alignment;

mandrel means adapted to be passed longitudinally between the piling member portions for progressively spreading apart the piling member portions laterally while the piling member portions remain in generally parallel alignment; and holding means for holding the piling member portions in their spread apart disposition of generally parallel alignment.

16. A method of forming a piling structure comprises the steps of:

inserting longitudinally into the ground at least two piling member portions in generally parallel alignment;

passing a spreading mandrel member longitudinally between the piling member portions to progressively spread apart the piling member portions laterally while the piling member portions remain in generally parallel alignment; and holding the piling member portions in their spread apart disposition of generally parallel alignment.

17. The method of claim 16 wherein the mandrel member is passed longitudinally between the piling member portions along substantially the entire lengths thereof.

18. The piling structure of claim 15 wherein the piling member portions are driven into the ground at the same time.

19. The method of claim 16 wherein the piling member portions are inserted into the ground at the same time.

20. The piling structure of claim 18 wherein the piling member portions are secured with respect to one another for being driven into the ground.

21. The method of claim 19 and further comprising the step of:

securing the piling member portions with respect to one another for insertion in to the ground.

22. A method as claimed in claim 11 wherein the piling member portion is deformed by passing a spreading mandrel longitudinally into the structure or ground anchor.

23. A structure or anchor as claimed in claim 1 wherein the piling member portion is aligned in a first position when driven or inserted into the ground, and wherein after deformation thereof, the piling member portion is placed in a second position which is generally parallel to its prior first position.

24. A method as claimed in claim 11 wherein the piling member portion is aligned in a first position when inserted into the ground, and wherein after deformation, the piling member portion is placed in a second position generally parallel to its prior first position.

* * * * *

UNITED STATES PATENT AND TRADEMARK OFFICE

CERTIFICATE OF CORRECTION

PATENT NO. : 4,768,900

DATED : September 6,1988

INVENTOR(S) : John B. Burland

It is certified that error appears in the above-identified patent and that said Letters Patent is hereby corrected as shown below:

On the front page of the patent, please add the following assignee:

-- 73 Assignee: Pile and Anchorage Limited, Hertfordshire, England

On the front page of the patent, in the References Cited section, under FOREIGN PATENT DOCUMENTS, please add the following references:

| | | | |
|---|---|---|---|
| -- | 568,374 | 3/1924 | France |
| | 874,212 | 4/1953 | Germany |
| | 2,159,613 | 6/1973 | France |
| | 104,723 | 4/1984 | EPO Appln. -- |

Col. 7, Line 39, delete "claim", and insert -- claim 1 --; Line 68, after "structure", delete "of", and insert --or--.

Col. 8, Line 1, delete "claim 11", and insert --claim 22--;

UNITED STATES PATENT AND TRADEMARK OFFICE

CERTIFICATE OF CORRECTION

PATENT NO. : 4,768,900

DATED : September 6, 1988

INVENTOR(S) : John B. Burland

It is certified that error appears in the above-identified patent and that said Letters Patent is hereby corrected as shown below:

line 5, delete "claim 11", and insert -- claim 22 --.

Signed and Sealed this

Twenty-ninth Day of August, 1989

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,768,900

DATED : September 6, 1988

INVENTOR(S) : John B. Burland

It is certified that error appears in the above-identified patent and that said Letters Patent is hereby corrected as shown below:

On the front page of the patent, please add the following assignee:

-- 73 Assignee: Wedge Pile and Anchorage Limited, Hertfordshire, England

On the front page of the patent, in the References Cited section, under FOREIGN PATENT DOCUMENTS, please add the following references:

| | | | |
|---|---|---|---|
| -- | 568,374 | 3/1924 | France |
| | 874,212 | 4/1953 | Germany |
| | 2,159,613 | 6/1973 | France |
| | 104,723 | 4/1984 | EPO Appln.-- |

Col. 7, Line 39, delete "claim", and insert --in claim 1--; Line 68, after "structure", delete "of", and insert --or--.

Col. 8, Line 1, delete "claim 11", and insert --claim 22--;

UNITED STATES PATENT AND TRADEMARK OFFICE

CERTIFICATE OF CORRECTION

PATENT NO. : 4,768,900

DATED : September 6, 1988

INVENTOR(S) : John B. Burland

It is certified that error appears in the above-identified patent and that said Letters Patent is hereby corrected as shown below:

Column 8, line 5, delete "claim 11" and insert -- claim 22 --.

This certificate supersedes Certificate of Correction issued August 29, 1989.

Signed and Sealed this

Thirteenth Day of March, 1990

*Attest:*

*Attesting Officer*

JEFFREY M. SAMUELS

*Acting Commissioner of Patents and Trademarks*